US007509081B2

(12) United States Patent
Bessette

(10) Patent No.: US 7,509,081 B2
(45) Date of Patent: Mar. 24, 2009

(54) HIGH-CAPACITY TONER CARTRIDGE AND TONER AGITATOR

(75) Inventor: Lionel C. Bessette, Millbury, MA (US)

(73) Assignee: Clarity Imaging Technologies, Inc., Springfield, MA (US)

( * ) Notice: Subject to any disclaimer, the term of this patent is extended or adjusted under 35 U.S.C. 154(b) by 98 days.

(21) Appl. No.: 11/612,271

(22) Filed: Dec. 18, 2006

(65) Prior Publication Data

US 2008/0145112 A1 Jun. 19, 2008

(51) Int. Cl.
*G03G 15/08* (2006.01)

(52) U.S. Cl. ..... 399/263; 399/254

(58) Field of Classification Search ..... 399/263, 399/262, 256, 254; 222/DIG. 1; 366/241, 366/244, 271, 279, 292, 293, 343
See application file for complete search history.

(56) References Cited

U.S. PATENT DOCUMENTS 5,216,462 A * 6/1993 Nakajima et al. ..... 399/254
5,325,163 A * 6/1994 Nishio ..... 399/262
5,884,130 A 3/1999 Tsutsumi et al.
6,459,876 B1 10/2002 Buchanan et al.
6,510,303 B2 1/2003 Bessette
7,177,567 B2 * 2/2007 Miller ..... 399/263

FOREIGN PATENT DOCUMENTS

JP 2001-305846 A * 11/2001
JP 2002-108086 A * 4/2002

* cited by examiner

*Primary Examiner*—Sophia S Chen
(74) *Attorney, Agent, or Firm*—William A. Loginov; Loginov & Associated PLLC

(57) ABSTRACT

An agitator blade and toner cartridge that enables a higher capacity of toner while lowering the load exerted by the print engine motor as toner is agitated. This allows for greater efficiency at low toner levels as the blade is brought closer to the inner wall of the cartridge toner tank. The blade consists of an axially directed axle shaft having a plurality of rigid, radially directed ribs A plurality of cross bar members are mounted between each pair of ribs. Each cross bar includes axially extended, rib-engaging wings. The wings are mounted so that the cross bars are generally prevented from passing between the ribs when the cross bars are driven by the ribs in the normal direction of agitator rotation. The toner cartridge can include a volume extension member that is sized to fit within the empty space of a corresponding print engine.

19 Claims, 12 Drawing Sheets

HIGH-CAPACITY TONER CARTRIDGE AND TONER AGITATOR

BACKGROUND OF THE INVENTION

1. Field of the Invention

This invention relates to toner cartridges used in electronic or laser printers and more particularly to moving agitators for delivering toner from the cartridge's toner tank to its toner metering and delivery components.

2. Background Information

Electronic or "laser" printers use a focused light beam to expose discrete portions of an image transfer drum so that these portions attract printing toner. Toner is a mixture of pigment (typically carbon black or a non-black color component) and plastic. The toner becomes electrostatically attracted to exposed portions of the image transfer drum. As a transfer medium such as paper is passed over the rotating image transferred drum, some of the toner is laid onto the medium. Subsequently, the medium passes through a heated fuser so that the plastic is melted into permanent engagement with the underlying medium.

The vast majority of desktop laser printers currently available utilize replaceable toner cartridges that incorporate an image transfer drum, a toner tank and a metering system and a drive mechanism for the drum and metering system. A one-part toner is used, in which the fusible plastic and colorant (typically carbon black in a black-and-white system) are combined together. Modern toner cartridges often include a variety of sensors that interact with the laser printer in order to indicate the status of the cartridge. Indications relating to toner level, print quality and general cartridge function are often included. A large number of types and sizes of toner cartridges are currently available. Each cartridge is provided with its own set of operating parameters and toner fill limitations. Some limitations are enforced by electronics within the cartridge and print engine that are set by the manufacturer. For example various cartridges, such as those used in the printers available from Lexmark International, Inc. utilize a complex sensing system for determining cartridge performance and preventing cartridge from being filled in excess of the manufacturer's specifications.

The cartridge's sensing system includes an encoder or timing wheel interconnected with one end of a rotating agitator blade within a semi-cylindrical toner tank. Movement of the agitator blade feeds toner into the metering system. The timing wheel reports the movement of the agitator through the toner reservoir. The resulting signal must fall within certain parameters, or a variety of error conditions are indicated by the printer, and print engine operation may suddenly cease.

The timing wheel includes a set of perimeter notches at predetermined arcuate positions. The notches interact with an optical or electromechanical sensor on the print engine. The timing wheel is fixed to the agitator blade via a common shaft. Coaxially mounted on the shaft is a main drive gear that is operatively connected with, and synchronized to the print engine drive train (including the developer roll, image drum, etc.). The timing wheel and agitator blade shaft together provide "lost motion" or dwell (or "float") with respect to the drive gear within a predetermined arcuate limit. In this manner the agitator is spring loaded and alternately dwells or snaps back against a spring stop as is passes through the toner load. If the toner load is too high, the dwell and snap back signals an overfill condition via the timing wheel. If the toner is too low, there is virtually no dwell/snapback, indicating an empty cartridge, both conditions will stop the print engine.

Commonly owned U.S. Pat. No. 6,510,303 B2, entitled EXTENDED-LIFE TONER CARTRIDGE FOR A LASER PRINTER, by Lionel C. Bessette, the teachings of which are expressly incorporated herein by reference, addresses certain problems encountered in providing a higher initial toner charge to a cartridge with strict sensing limitations on volume. In essence, the timing components are modified to allow wider/different range of dwell and snapback encountered with a higher initial toner level without causing the printer to stop. This teaching also provides for an enlarged cartridge volume via an attached extension. Likewise, commonly owned U.S. patent application Ser. No. 11/246,926, now U.S. Pat. No. 7,433,612 entitled TIMING WHEEL FOR TONER CARTRIDGE WITH DUAL SPRINGS, also by Lionel C. Bessette, the teachings of which are expressly incorporated herein by reference also solves certain timing problems encountered as the level of toner decreases as it is expended over time.

These teachings seek to address particular electronic limitations posed upon over-filled cartridges by the print engine. However, increasing the quantity of toner may also lead to certain physical limitations on performance. When the toner level/volume in a cartridge is increased, the agitator must work harder as it traverses the toner load. Agitators generally consist of a main axle shaft that engages the timing gear and the floating main drive gear. The shaft supports a series of radially projecting ribs along its axial length. These ribs are topped by a cross bar that is located close to the cylindrical inner wall of the toner tank. The cross bar acts to scoop the toner out of the tank and deposit it in the toner metering area, where it is deposited upon a magnetic developer roll, or conductive elastic roller leveled by a doctor blade and then selectively directed to the electostatically charged, photoconductive image drum.

The cross bar is most useful when the toner level is relatively low and toner must be physically carried into the metering area from the bottom of the tank. At higher fill levels, the toner simply migrates by gravity into the metering area, and the cross bars merely "agitate" the load. Unfortunately, the higher the level, the greater the drag on the agitator, and hence, the print engine motor. Conversely, the cross bar must provide some standoff space with respect to the toner tank's inner wall to allow toner to flow around it, especially at higher fill levels, so as to prevent jams. This reduces its ability to scrape out and scoop up the last bits of toner when the cartridge is nearly empty. In essence, it is highly desirable to employ less agitation at higher fill levels, while more-aggressive scooping at lower fill levels would increase efficiency. The current agitator blade is a tradeoff between these two opposing goals.

SUMMARY OF THE INVENTION

This invention overcomes the disadvantages of the prior art by providing an agitator blade and toner cartridge employing such an agitator blade that enables a higher capacity of toner while lowering the load exerted by the print engine motor as toner is agitated. This blade and cartridge also allows for greater efficiency at low toner levels as the blade is brought closer to the inner wall of the cartridge toner tank. The blade consists of an axially directed axle shaft having a plurality of rigid, radially directed ribs that extend to a location proximate to the inner wall of the tank. A plurality of cross bar members are mounted between each pair of ribs. The cross bar members are constructed from a relatively thin, flexible polymer sheet and include a pair of radially directed side walls that extend to an L-shaped cross bar. The side walls lay relatively flushly against adjacent walls of ribs. The side walls are mounted in a manner that is not rotationally fixed, so as to freely rotate on the axle shaft. Each L-shaped cross bar includes axially extended, rib-engaging wings that seat within recesses in each rib. The wings and recesses re mounted so that the cross bars are generally prevented from passing between the ribs when the cross bars are driven by the ribs in the normal direction of agitator rotation. However, the wings are sufficiently resilient so that a predetermined level of toner resistance, typically at high fill levels, causes the wings and cross bars to elastically deform and pass through the ribs, leaving only the thinner ribs to traverse the toner in that cycle. At the end of the cycle, the agitator ribs meet up with, and engage the cross bar members again, and depending upon the level of toner resistance, the cross bars either (a) hold, passing with the ribs through the toner, or (b) break away for another cycle, until the toner level is sufficiently low. Also, the cross bars are located in closer proximity to the tank inner wall than a conventional agitator, which allows for more efficient scraping and scooping. A second rib-engaging wing can be located along the length of each side wall between the cross bar and base for added support against break-away.

In an illustrative embodiment, the toner cartridge can include a volume extension member that is sized to fit within the empty space of a corresponding print engine. The cartridge can include a floating timing wheel with at least two different spring tensions for differing levels of toner resistance and the cartridge can include an improved doctor blade that curves along its length to more evenly deposit toner on the image transfer drum. The toner cartridge can also include a compound-angle doctor blade in engagement with the cartridge's developer roller for better distribution of toner.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
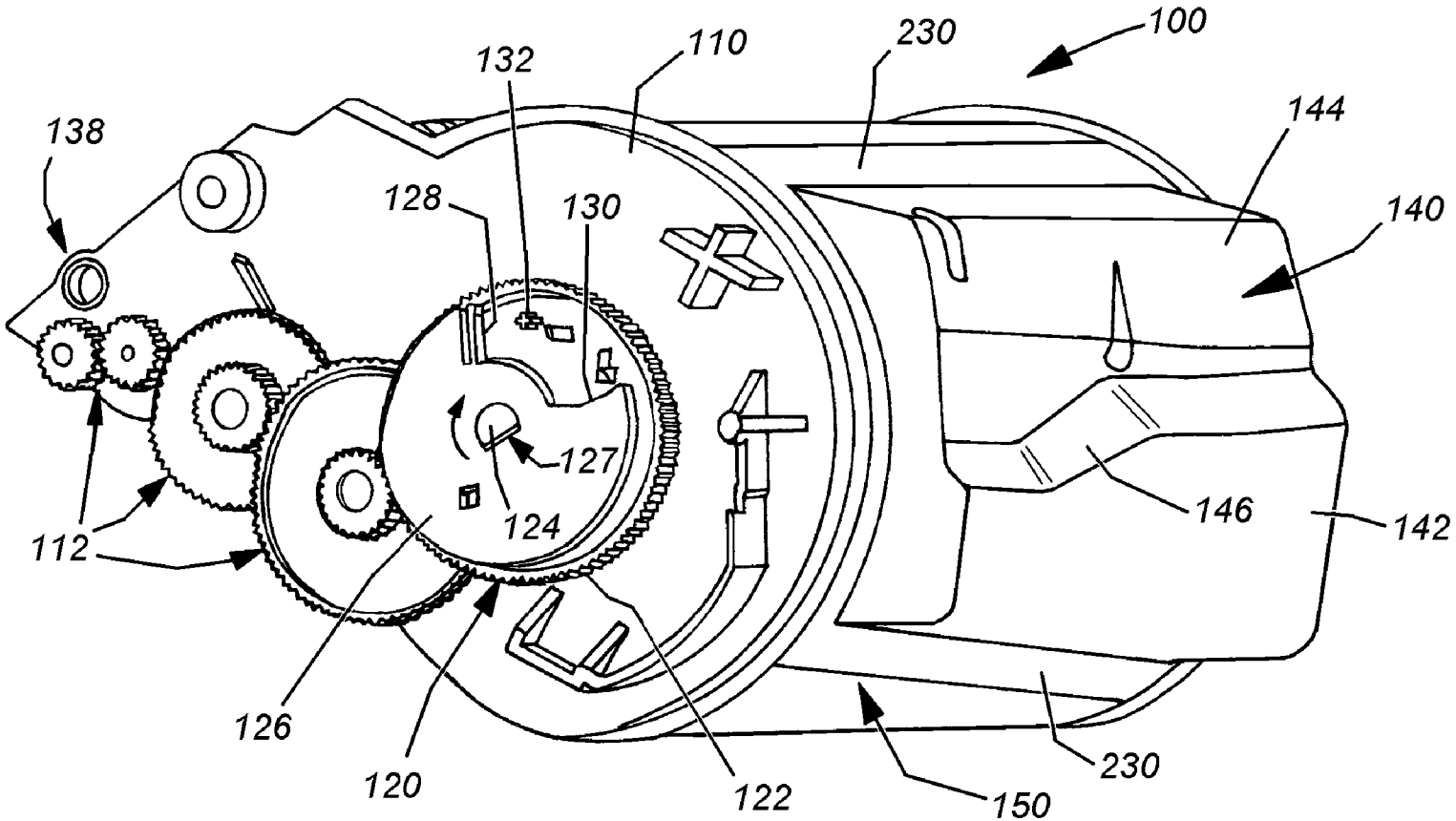
FIG. 1 is a perspective exterior view showing an exemplary toner cartridge housing employing an inventive volume extension in accordance with this invention.

FIG. 1 details an exemplary toner cartridge 100 for use in accordance with an illustrative embodiment of this invention. This cartridge is employed in, for example, a commercially available T630 print engine, available for Lexmark International, Inc. However, the principles described herein are applicable to a wide variety of other cartridges, available for use in Lexmark and other manufacturers' print engines, including, but not limited to the T620, T630, T640, T520, T530, OptraS, OptraT, and their variations. In general, the teachings herein are applicable to any cartridge that employs an agitator and can deliver toner to the metering area without substantial agitation when filled to a high level.

The exemplary cartridge 100 includes a housing 110 that supports an external gear train 112. At least one of the gears removably engages a print engine drive motor gear (not shown) when the cartridge is properly installed in the print engine. The main agitator gear assembly 120 is shown at the end of the train 112. This assembly consists of a gear 122 that freewheels on the end of the agitator axle shaft 124. The gear moves within predetermined limits that are governed by its engagement with an external timing wheel 126. The wheel 126 includes a cutout with opposing stops 128, 130 that engage a stop 132 on the gear 122. The wheel 126 is mounted in a rotationally fixed orientation with respect to the shaft 124, as provided by the D-shaped shaft end 127. The gear 122, thus, rotates continually as part of the gear train 112 and corresponding cartridge/image elements, while the agitator axle shaft floats between the stops 128, 130 under the resistance force of a pair of springs (not shown) sandwiched between the wheel 126 and the gear 122. This structure allows the agitator to variably resist movement into the toner until the springs apply sufficient force thereto. As the agitator is dragged fully through the toner, the resistance applied by the toner on the springs is eventually relieved and the springs cause the timing wheel to snap the axle 124 from a position adjacent to the stop 130, back to the opposing, shock-absorbing stop 128. This assembly 122 can be termed herein a "dual-spring floating timing wheel and gear assembly" and is described in further detail in the above-incorporated U.S. Patent application entitled U.S. patent application Ser. No. 11/246,926, entitled TIMING WHEEL FOR TONER CARTRIDGE WITH DUAL SPRINGS, also by Lionel C. Bessette. Note that this dual-spring floating timing wheel and gear assembly can be omitted in alternate embodiments in favor of another agitator driving arrangement.

The cartridge gear train 112 drives several rollers (described below) that are part of the toner metering system. These components all move in synchronization with an image transfer drum (refer below) that resides at the outlet 138 of the cartridge 100 under control of the print engine drive motor and its associated control electronics. Notably, the cartridge housing 110 has been provided with a rear volume extension member 140. The volume extension member 140 allows extra toner to be provided to the cartridge. In this embodiment, a conventional original equipment manufacturer (OEM) specification cartridge of the type shown contains a maximum toner load of approximately 800-850 grams. With the volume extension member 140 in place, filling to a higher level, and employing the novel features described herein, the exemplary cartridge can be reliably provided with a toner load of approximately 1250 grams. The extension member 140 is located in the upper rear region of the toner tank and is oriented so that extra toner therein is fed by gravity into the main tank volume with need of direct agitation. In this embodiment, the volume extension member provides room for an additional 200-300 grams of toner. Other levels of supplementary toner are, or can be, accommodated in alternate embodiments using differing sized and shaped volume extensions. The exterior shape of the volume extension 140 includes a more-outwardly extended bubble 142 located lower on the extension body and a smaller, more-recessed bubble 144 above the lower bubble 142. The lower bubble 142 also includes a slope 146. In this embodiment, the lower bubble extends outwardly from the surrounding housing surface 150 approximately 1 to 1¼ inches, while the lower bubble extends outwardly about half this distance. This two-tiered, sloped shape helps the extension conform to the existing open space in the associated print engine and also the help urge toner by gravity out of the extension member 140 as the overall level of toner declines.

Figure 2:
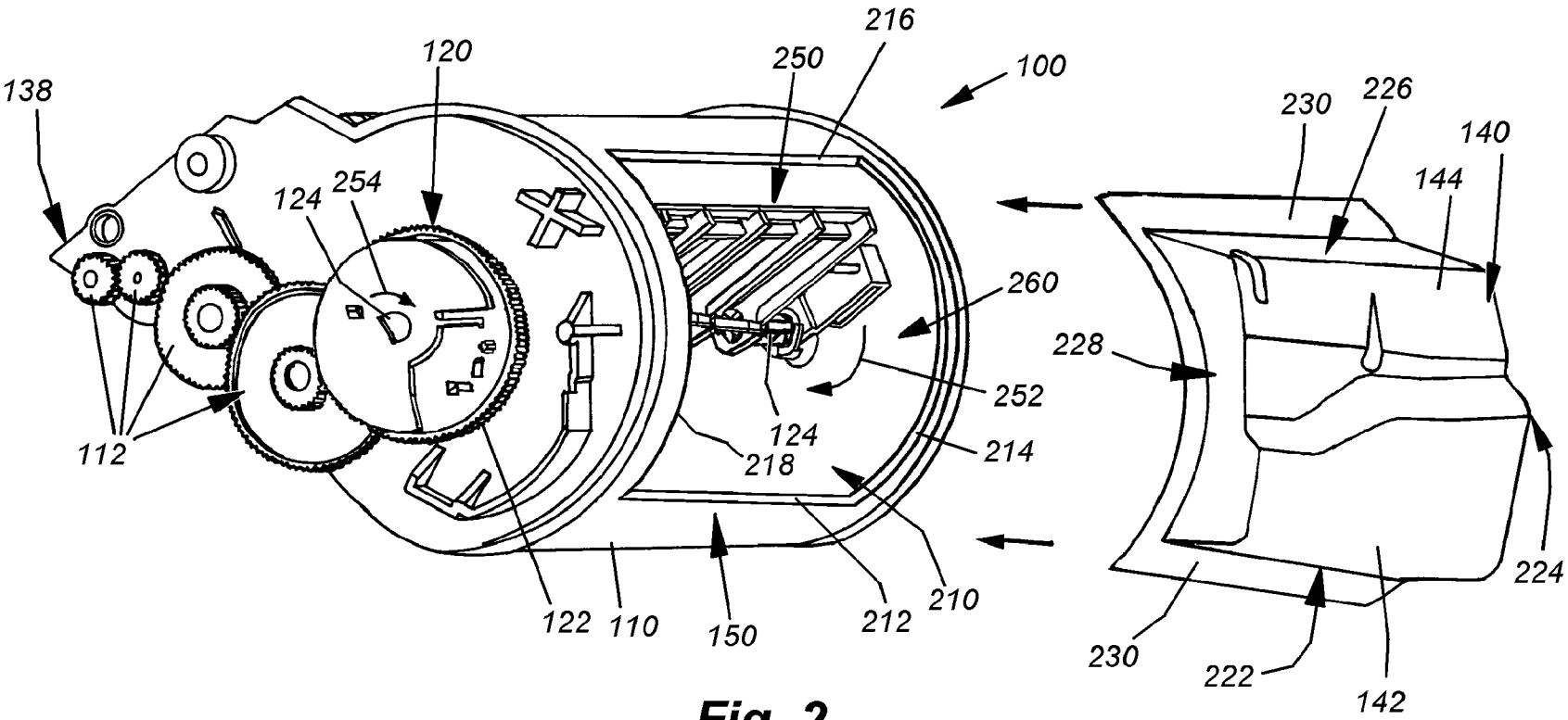
FIG. 2 is an exploded perspective view of the toner cartridge of FIG. 1 with the extension removed to reveal the inventive agitator of this invention.

As shown in FIG. 2, the volume extension member 140 is assembled onto the rear of the housing 110 so as to cover an opening 210 formed in the tank wall. The opening is sized so that its edges 212, 214, 216, 218 are relatively aligned with the outwardly extended side walls 222, 224, 226, 228, respectively, at the corner between the walls and the extension's mounting flange 230. The flange is shaped to overlie the exterior face 150 of the housing. It is attached by fasteners, adhesives, plastic-welding, or any other acceptable technique that joins the component in a manner that minimizes toner leakage. The opening 210 can be formed during manufacturing of new housings or can be cut into preexisting sealed housings using manual or automated cutting processes.

With further reference to FIG. 2, the agitator assembly 250 according to an illustrative embodiment of this invention is shown mounted within the tank interior 260. As described previously, the agitator is adapted to rotate (arrow 252) around the tank based upon the floating rotation (arrow 254) of the dual-spring floating timing wheel and gear assembly 120.

Figure 3:
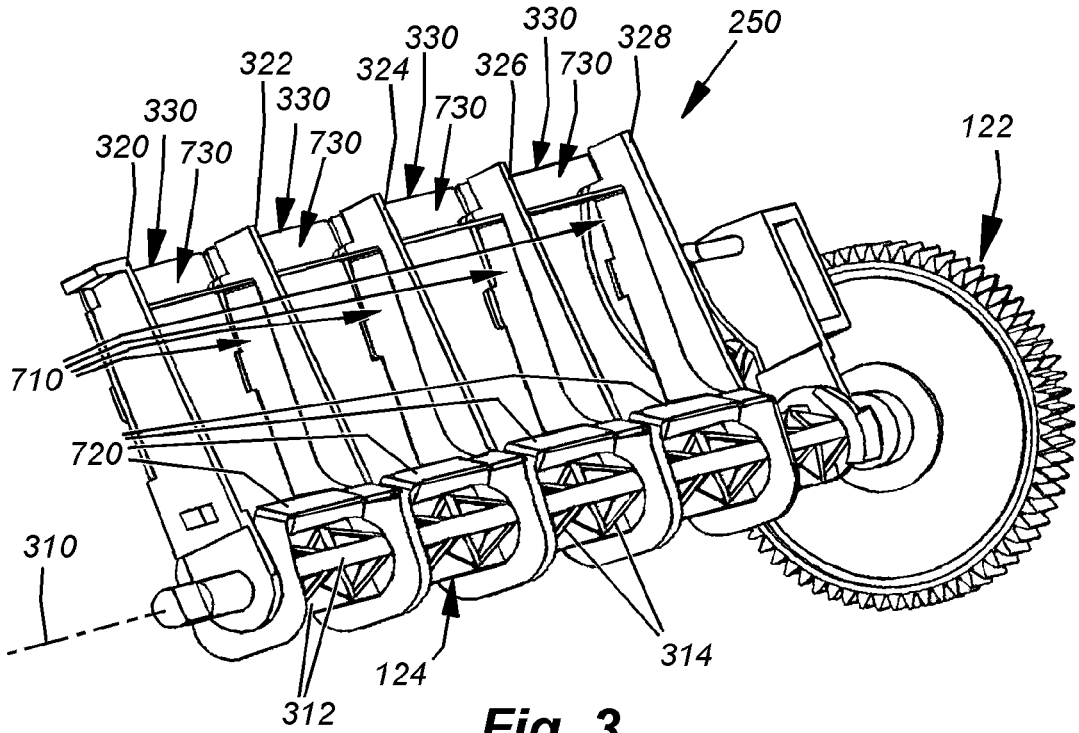
FIG. 3 is a perspective view of the agitator and main drive gear assembly in accordance with an illustrative embodiment.
Figure 4:
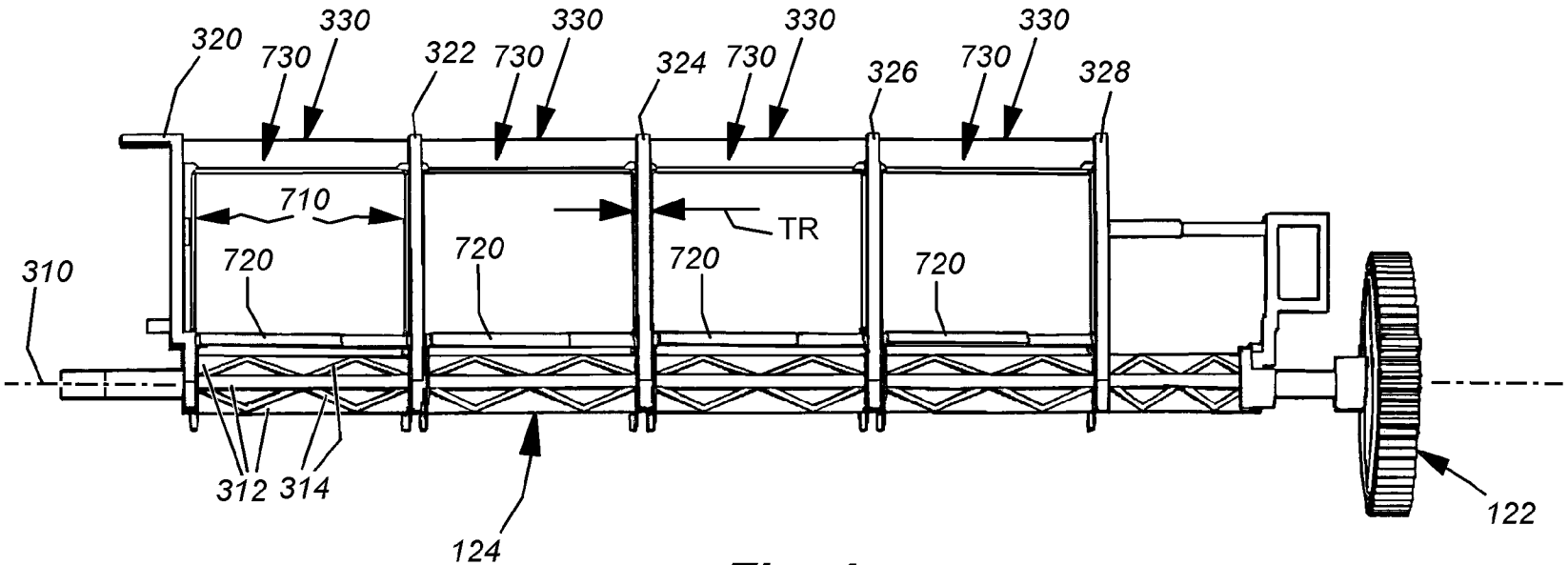
FIG. 4 is a frontal view of the agitator of FIG. 3.
Figure 5:
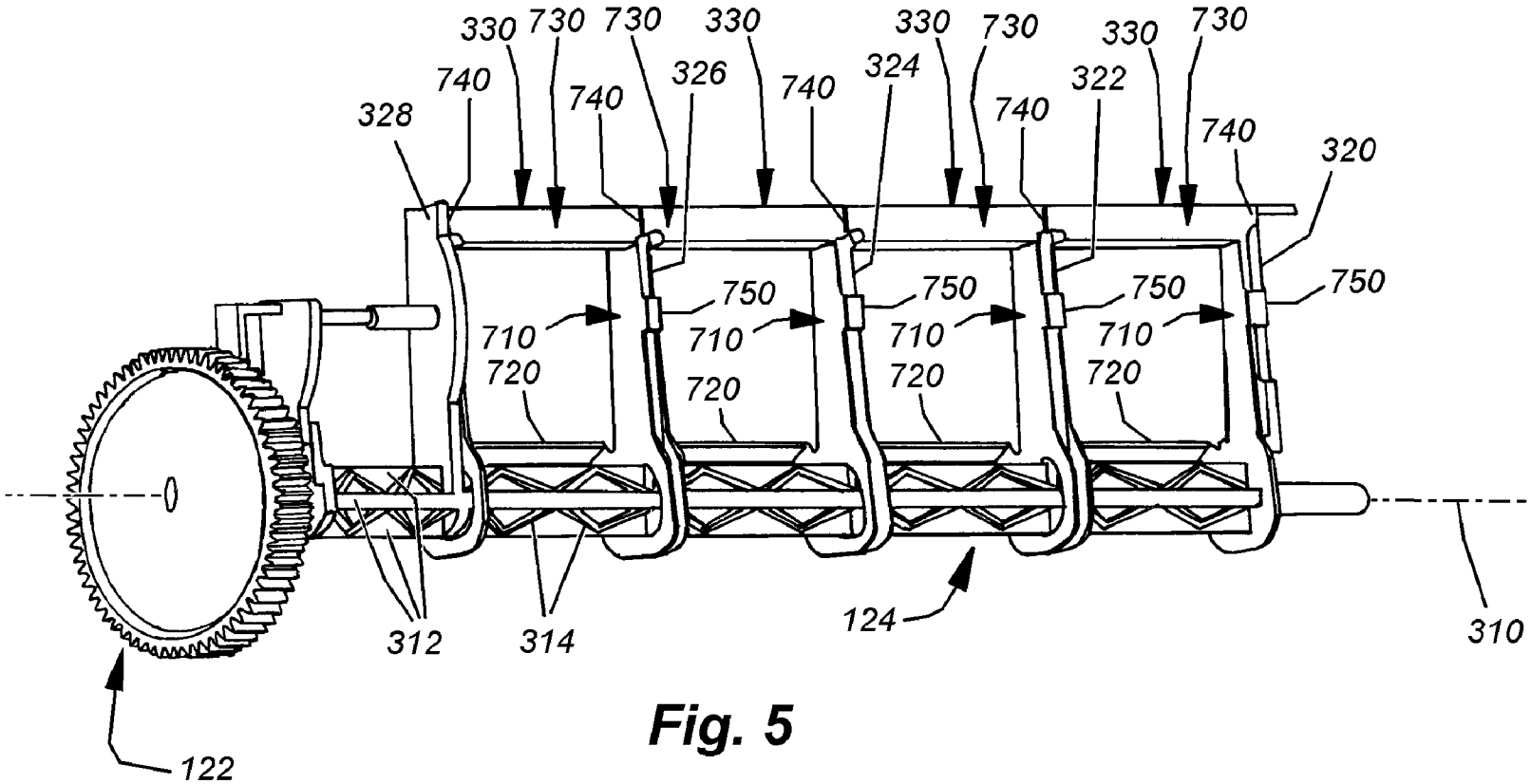
FIG. 5 is a reversed perspective view of the agitator of FIG. 3.

Reference is now made to the novel agitator assembly 250, which is shown in further detail in FIGS. 3-5. The agitator comprises a rigid axle shaft defined around a central rotational axis 310. In this example, the shaft is constructed from a plurality of axially oriented webs 312 that, in cross section define a cruciform shape. The webs are strengthened by unitarily molded trusses 314. The shaft's cruciform cross section shape falls within the four 90-degree the points of a circle, and thus, a member with a circular hole can freely rotate on the shaft 124.

Five radially projecting ribs 320, 322, 324, 326 and 328 are mounted along the shaft at even, axially directed intervals. These ribs are molded unitarily with the shaft 124 in this embodiment. They are aligned rotationally (e.g. they are all at 0-degrees of rotation with respect to each other). The ribs are more clearly viewed in FIG. 6 with surrounding components removed.

Figure 7:
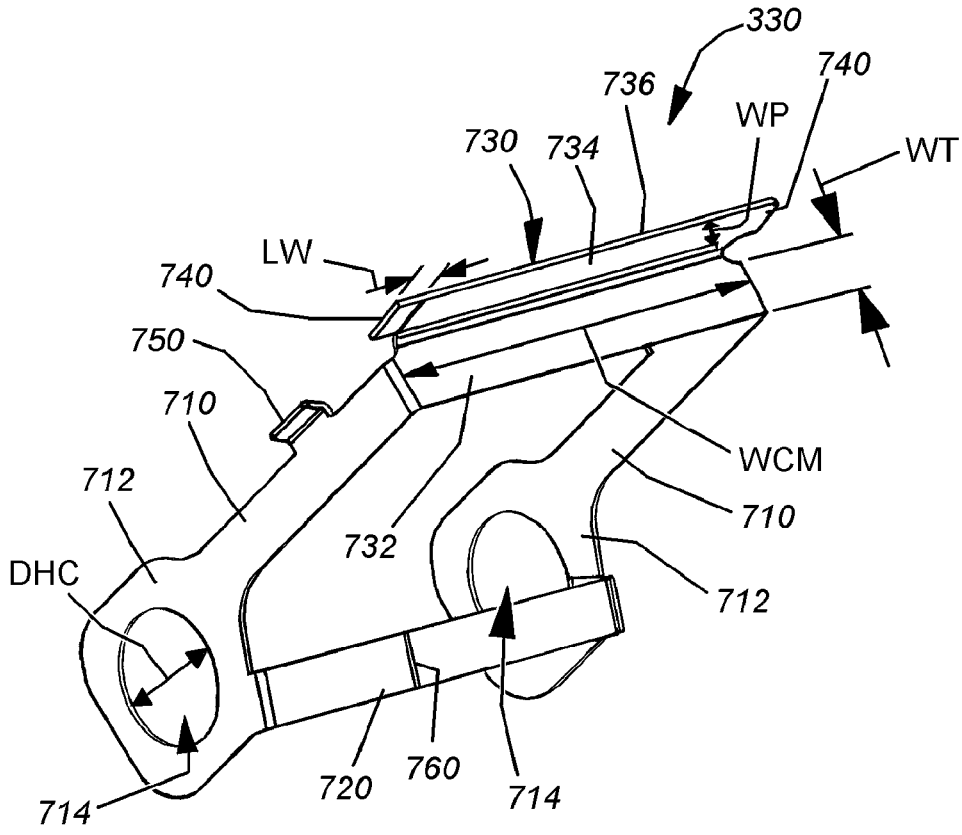
FIG. 7 is a perspective view of a cross bar member for use in the agitator of FIG. 3.

The components surrounding each pair of ribs are the inventive, break-away cross bar members 330 according to this invention. Four cross bar members 330 are provided between each pair of five ribs in this example. A greater or smaller number of ribs and members can be employed in alternate embodiments and/or for other types of cartridges. An exemplary cross bar member 330 is shown disconnected from the agitator 250 in FIG. 7. Each cross bar member 330 has an overall width WCM that places each of a pair of opposing side walls 710 flush against opposing walls of a pair of agitator ribs 320. In this example WCM is approximately 1.78 inches. The base 712 of each sidewall is widened to provide clearance for a through hole 714. Each through hole 714 has a diameter DHC that is equal to or slightly greater than the diameter of the axle shaft 124 (the circle diameter defined by the shaft's webs 312). In this example DHC is approximately 0.5 inch. As will be described below, the diameter of base holes 714 is slightly greater than the circle circumscribed by the shaft 124 to allow lateral play of the cross bar members 330 with respect to the shaft 124. This allows each cross bar member 330 to rotate freely on the shaft, being captured axially between a pair of ribs. The bases 712 are joined by a lower tie 720 that is formed unitarily with each base 712. This axial tie helps to maintain the rigidity and alignment of the bases to prevent binding on the shaft 124. The upper end of the side walls 710 carry a unitary cross bar 730. The cross bar is L-shaped for axial and tangential rigidity and strength as it passes through the toner. It includes a tie portion 732 that extends between the side walls 710 and a radially projecting paddle portion 734. The tie portion 732 has a width WT of approximately 0.2 inch and the paddle portion 734 has a width WP of approximately 0.2 inch. These measurements, and other dimensions herein, can vary based upon the material being employed and relative size and configuration of the toner cartridge. The paddle portion 734 can extend radially to a length that places it nearly in contact with the inner wall of the toner tank as described below. This length is approximately 2.01 inches from the center axis of the hole 714 to the radial edge 736 in this example.

Figure 6:
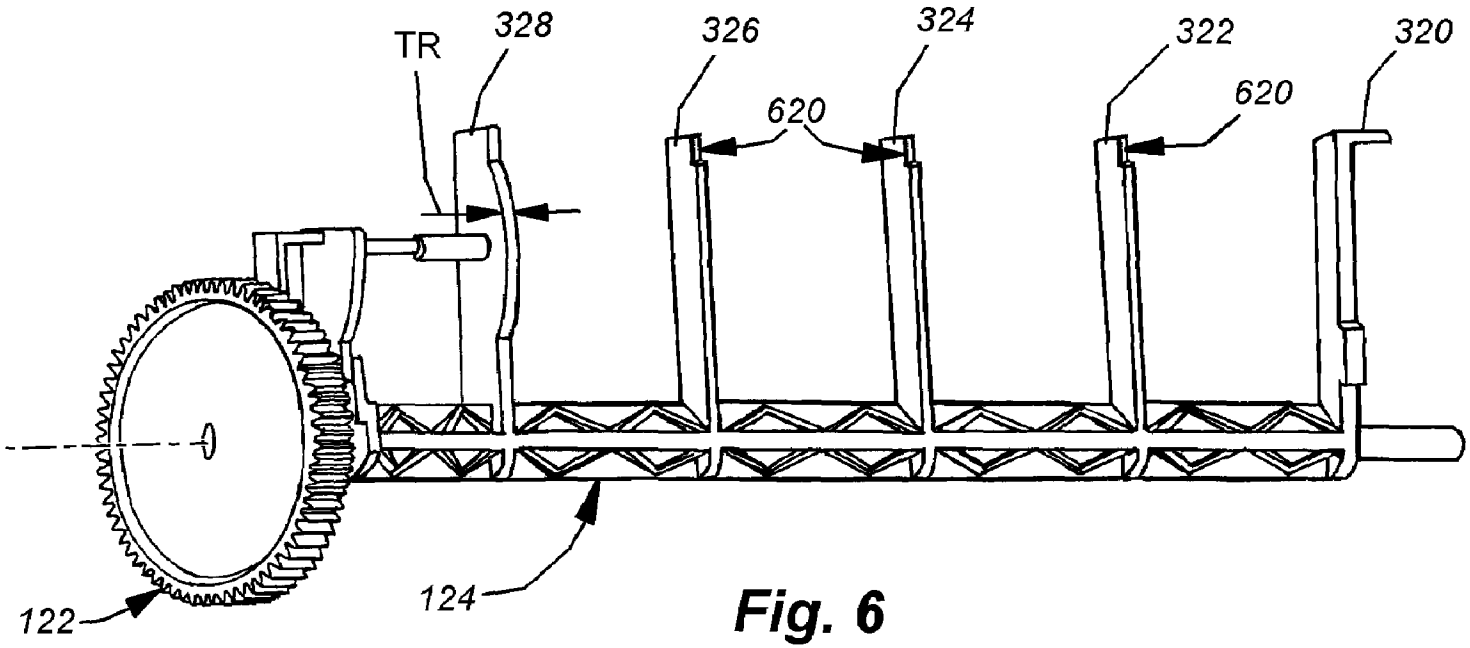
FIG. 6 is a reversed perspective view of the agitator of FIG. 3 with cross bar members removed to reveal the detail of the fixed ribs.

Notably, each member's paddle portion includes a pair of opposing side wings 740 that extend axially outward beyond the adjacent side wall 710. The distance of extension is between approximately ½ and 1 times the thickness TR (see FIGS. 4 and 6) of a rib. This causes the ribs to interfere with free rotation of the cross bar members when the side wings engage the ribs. As shown in FIG. 6, various ribs contain recesses 620 oriented along the rib side that engages the wings 740 of members 330 in the normal direction of rotation. That is, as the ribs rotate during a print cycle, the side wings are engaged and captured by the recesses. The wings 740 can either abut each other or overlap when captured by the ribs. The wings have a length LW of between approximately 1/16 and ¼ inch.

The side walls variously include a second pair of wings 750 located along their length between the base 712 and cross bar 730. In this example the tops (radially outermost ends) of the secondary wings 750 are located approximately ¼ inch below the cross bar toe 732. As will be described in detail below, the paddle (734) wings 740, and the secondary wings 750 act as resilient, elastically deformable stops that allow the respective cross bar member 330 to break away from the agitator ribs in contact with a sufficiently large supply of toner. In this manner, wings serve to control the resistance torque applied to the agitator by the toner. It is contemplated in an illustrative embodiment that either the paddle wings 740 or the secondary wings 750 are used to control torque, and are sized and arranged to provide the appropriate level of resistance to break-away. Where the upper, paddle wings 740 are used to control torque (as in the illustrative embodiment), the secondary wings assist in guiding the respective cross bar member sidewalls 710 (to which the wings 750 are connected) between the agitator ribs without hangup. Note that the end rib 328 is enlarged, and an abutting secondary wing (750) can be omitted from the cross bar member 330 at this location.

The cross bar members are typically constructed from a resilient and durable polymer sheet (or flexible metal in alternate embodiments), or could be formed by a variety of alternate techniques, including, but not limited to, various molding processes. In an illustrative embodiment, the material is 0.02-inch thick Polyethylene Terephthalate (PET) plastic sheet. It is folded and formed by heat into the depicted shape. The lower tie 720 can be secured together from separate pieces that extend respectively from each base 712 (seam line 760), while other parts of the cross bar member 330 are cut from single, seamless unit. The thickness of the sheet, its flexibility, and the outwardly extended length of each wing 740, 750 allows the member elastically flex, and non-damagingly break through the ribs under sufficient pressure.

Reference is now made to FIGS. 8-12, which show the agitator 250 mounted within the exemplary toner cartridge housing 110 in simplified cross section. The cartridge includes the synchronized, rotating rollers, including an adder roller 810 and a contacting developer roller 820. The developer roller 820 can include a conventional, electrostatically conductive elastomeric covering, or a multi-pole internal magnet that aids in the pickup of toner and subsequent release of toner to charged portions of the photoconductive image transfer drum 830. A metering or "doctor" blade 840 can be provided at the outlet of the housing 110. The blade 840 contacts the surface of the developer roller 820 and thereby defines an impingement line 842 that scrapes excess toner from the roller as it rotates (arrow 844) toward the image transfer drum 830. The excess toner falls back into the metering section space 850 for future application to the developer roller 820 through movement of the adder roller 810, etc. The doctor blade 840 can be varied in orientation along its length to compensate for observed effects that may lead to uneven toner distribution along the length of the roller 820. In an illustrative embodiment, the blade's working face is formed to create a setback that is compound angle in two orthogonal directions (with respect the lengthwise direction, parallel to the roller axis). This compound angle reorients the upstream corner of the working face to compensate for irregular metering and electrostatic differences across the roller surface (in the axial direction), particularly where toner is greater on one side of the roller than the other, opposing side. The doctor blade 840 may be constructed in accordance with the teachings of commonly assigned U.S. patent application Ser. No. 11/181,602, now U.S. Pat. No. 7,272,349. entitled DOCTOR BLADE FOR TONER CARTRIDGE DEVELOPER ROLLER, by Lionel C. Bessette, the teachings of which are expressly incorporated herein by reference. For the purposes of this description, the term "compound-angle doctor blade" shall refer to such a blade, and variations thereto.

Figure 8:
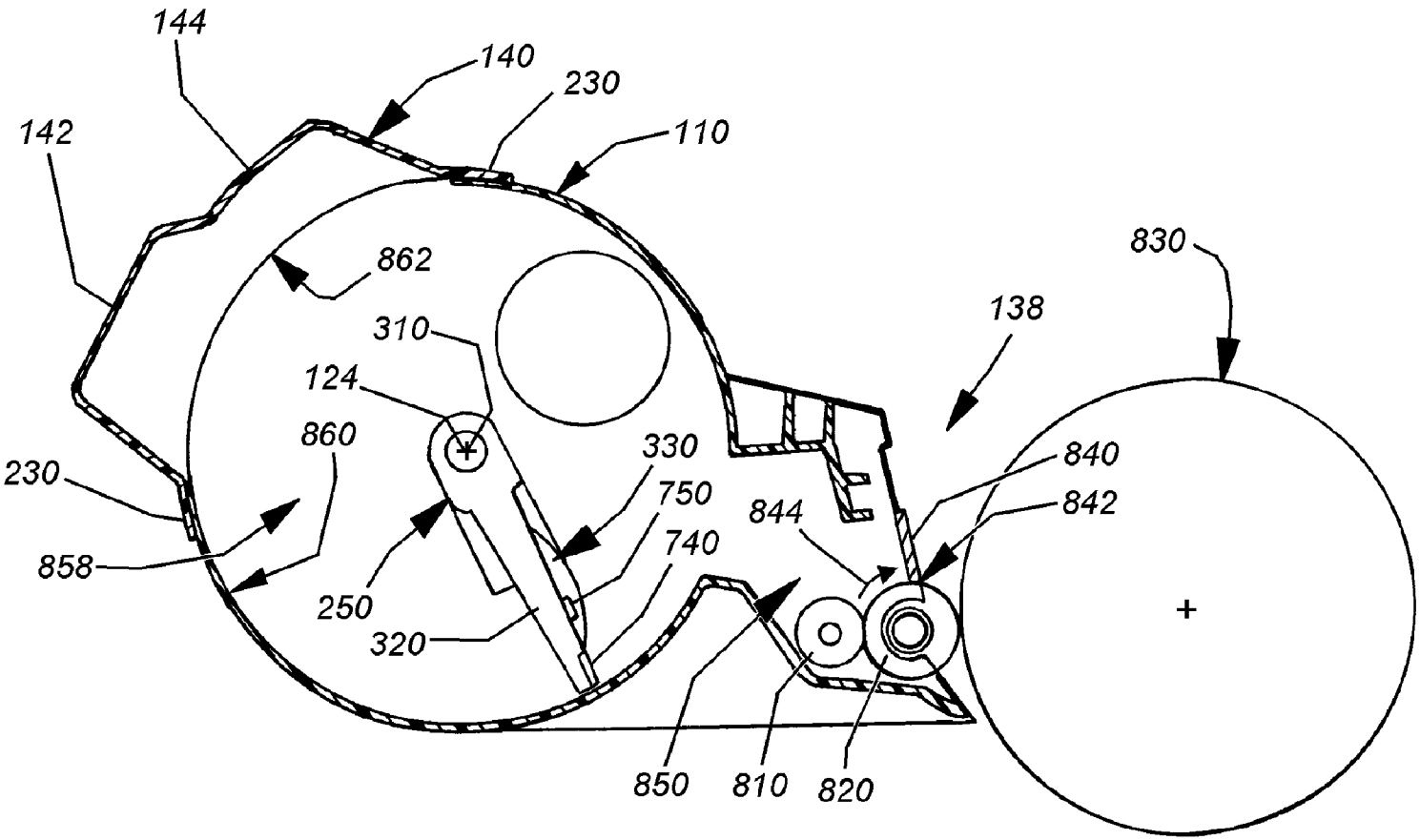
FIG. 8 is a side cross section of the agitator of FIG. 3 mounted in the exemplary toner cartridge of FIG. 1.

As shown in FIG. 8, the empty cartridge defines a cylindrical tank volume 858 inner tank wall 860 that is cut away at the upper rear quadrant 862 to accommodate the volume extension 140. Note that the volume extension's size, shape and orientation can vary to conform to the inner dimensions of a particular print engine for which the cartridge is intended.

The agitator 250, according to this invention is shown in engagement with the bottom of the tank wall 860. The cross bar members 330 are in full engagement with the agitator ribs (rib 320, for example).

Figure 9:
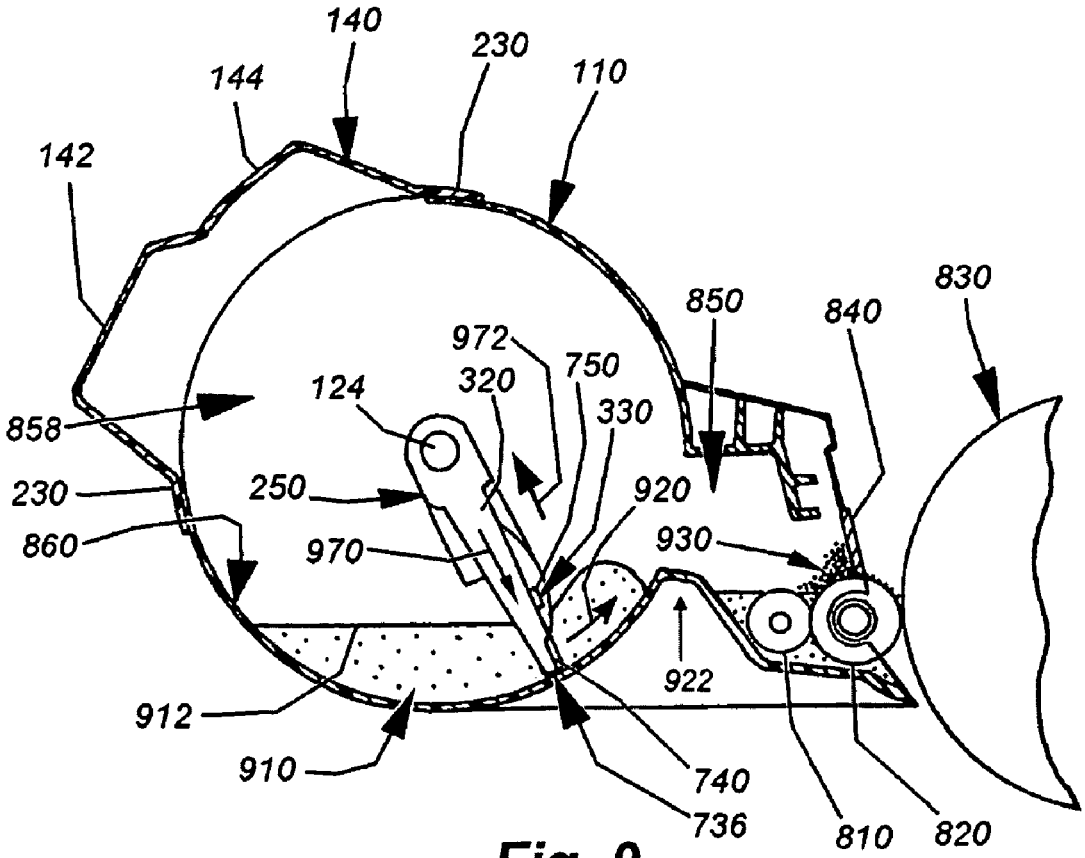
FIG. 9 is a side cross section of the agitator and cartridge assembly of FIG. 7 showing movement of the agitator at low toner fill levels.

Referring now to FIG. 9, the tank volume 858 is mostly empty, with the toner supply 910 defining a fill line 912 near the bottom. The agitator moves through this low-level of toner with minimal resistance. Toner on the leading edge of the agitator is swept/scooped up by the cross bar member 330 in the direction of rotation (arrow 920) over a separating hump 922, and deposited in the metering space for subsequent deposition. Note that the doctor blade 840 acts to scrape excess toner 930 from the developer roller 820, thereby ensuring that an appropriate level of toner is deposited on the developer roller as shown. Because the resistance applied by the toner supply 910 at this level is relatively low, the cross bar member is not sufficiently biased to break through the ribs. Rather, the wings 740, 750 restrain the cross bar member 330 with respect to the ribs.

Notably, the flexible and break-away nature of the cross bar member 330 allows the outermost edge 736 to be placed in close proximity, or even contact, with the inner wall 860 of the tank volume. This provides, in essence, a squeegee effect that ensures more toner from the supply 910 will eventually be delivered to the metering space 850. This reduces wasted toner left at the bottom of the tank when the electronics finally detects an empty condition, and thereby increases overall cartridge yield. To assist the squeegee effect, the cross bar member base holes (714 in FIG. 7) can be made slightly oversized with respect to the prevailing diameter of the axle shaft 124. This allows the cross bar members to shift slightly downwardly (arrow 970—away from the axle shaft) along the ribs under force of gravity as the agitator faces downwardly into the tank. In this manner, the edges 736 can contact the inner wall 860 of the tank, but still slide upwardly (arrow 972—toward the axle shaft) when surface variations and small obstructions are encountered. Naturally, if the cross bar member(s) encounters larger obstructions this may cause the cross bar member(s) to break through the ribs.

Note also that, in this embodiment, the dual-spring floating timing wheel and gear assembly (120), allows the agitator to float to some extent. The level of toner is still high enough to generate the amount of float needed for the printer electronics to indicate a non-empty condition.

Figure 10:
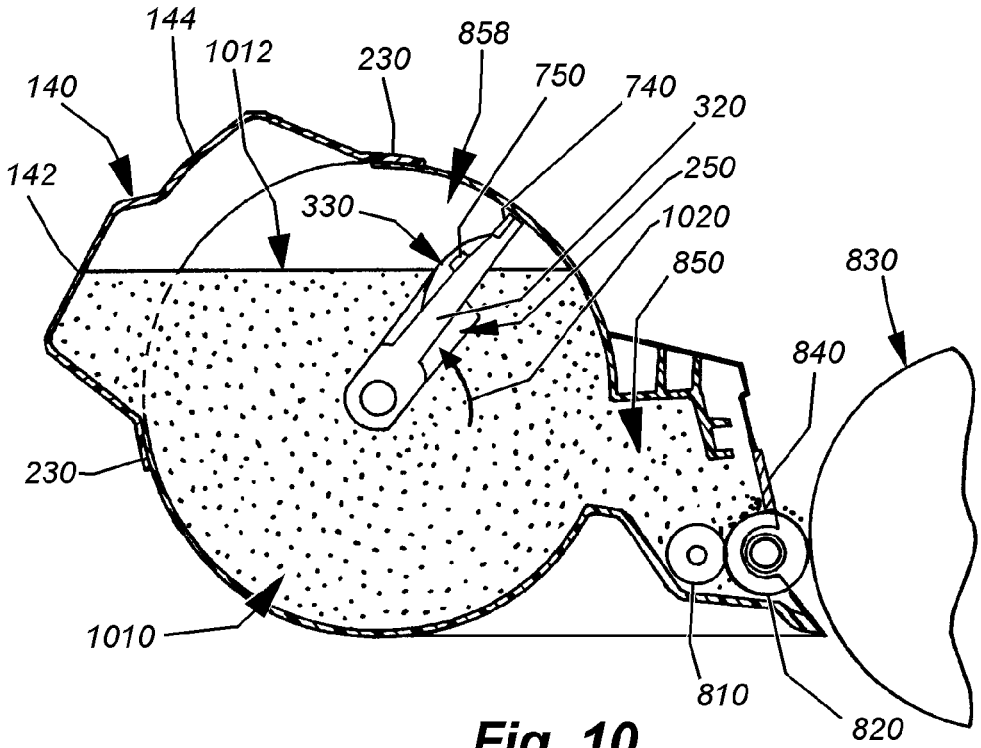
FIG. 10 is a side cross section of the agitator and cartridge assembly of FIG. 7 showing an initial movement of the agitator at high toner fill levels.

FIG. 10 shows the cartridge housing 110 a toner supply that is mostly full, defining a toner fill line 1012 that extends into the volume extension 140. The agitator 250 is beginning a rotational cycle (possibly for the first time after filling) as indicated by the arrow 1020. The cross bar member 330 is shown in engagement with the ribs (320, etc.). At this fill level, the metering volume 850 is in communication with an ample supply of toner that is fed to it largely by gravity. Thus, there is no need to scoop toner into the volume 850 from the tank sump as shown in FIG. 9. At this high, level of fill, the toner needs little or no agitation.

Figure 11:
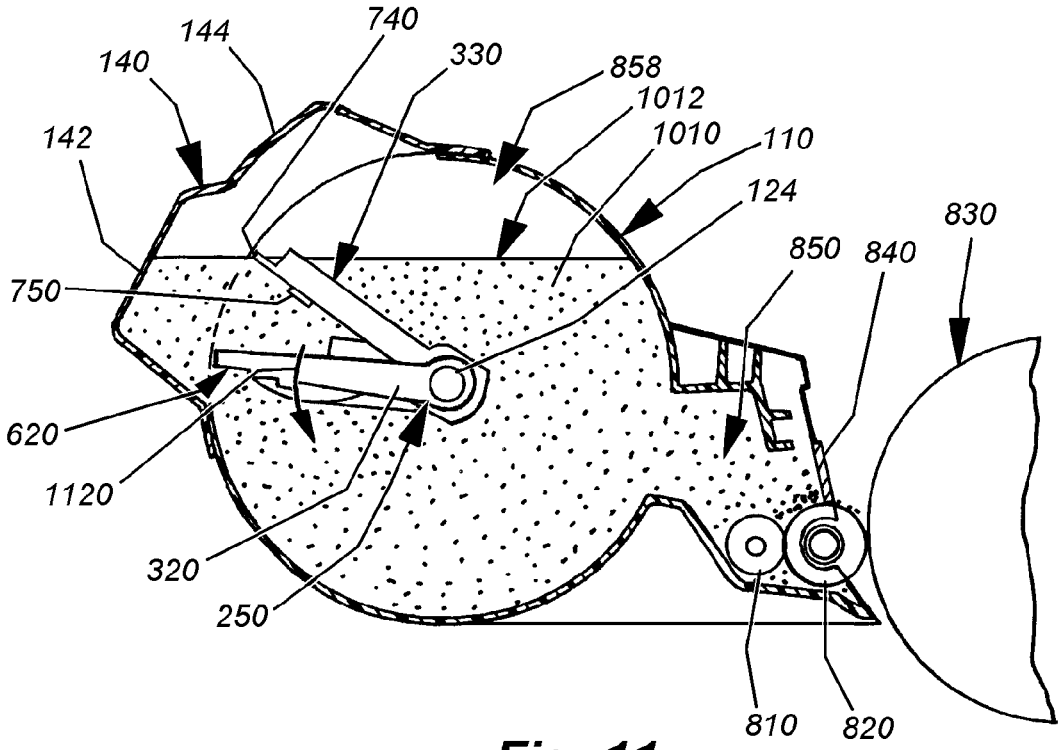
FIG. 11 is a side cross section of the agitator and cartridge assembly in FIG. 10 showing break-away of cross bar member(s) upon encountering the high toner fill level.

In some manufacturer-specification cartridges, the maximum allowable resistance against the agitator is approximately 15 pounds. This level of resistance places strain on the print engine drive train, and a lower level of resistance is highly desirable. Using the break-away cross bar members 330 of this illustrative embodiment, maximum resistance can be lowered to approximately 2-2.5 pounds (before break-away), significantly reducing the load on the engine, while maintaining sufficient agitation at fill levels that exceed manufacturer's specification. As shown in FIG. 11, a 2-2.5-pound level of resistance is sufficient to cause the wings 740, 750 of the cross bar member 330 to flex, and allow the shaft 124 and interconnected ribs (320, etc.) to break away from the cross bar member 330. The ribs continue their rotation (arrow 1120) through the toner supply 1010, with reduced resistance due to their narrow cross section without the cross bars. The prevailing resistance still provides a degree of resistance needed for appropriate lag and snap both avoiding jams and overstressing of components at the desired higher fill levels. A small degree of agitation is still provided by the ribs, breaking up clumps, and ensuring that toner will continue to migrate toward the bottom and metering volume 850. The broken-away cross bar members 330 are pressed against the toner, not far below the line 1012.

Figure 12:
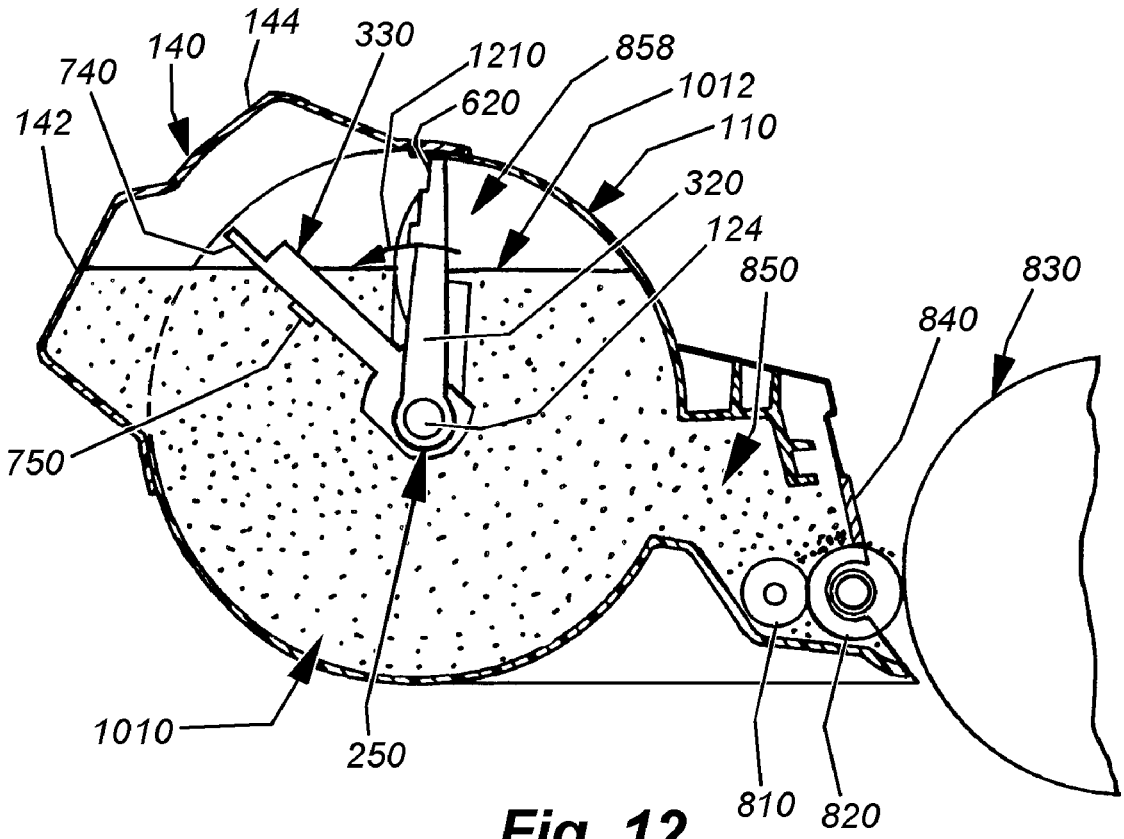
FIG. 12 is a side cross section of the agitator and cartridge assembly in FIG. 10 showing the completion of an agitation/print cycle in which the ribs are again encountering the cross bar members to begin the next cycle.

In FIG. 12, the shaft 124 and ribs 320 have rotated (arrow 1210) back out of the toner line 1012 and are heading for the cross bar member, which is seated in the toner. So long as the toner level is sufficiently high, some or all of the members' wings 740, 750 will yield in response to toner supply resistance. Yield may occur near the surface line 1012 as shown or deeper within the supply volume. It is contemplated that the cross bar member may slowly advance through the volume with each successive cycle as break-away may occur after the cross bar member has advanced a small distance into the toner volume and then become stopped. Eventually, when the toner level is low enough to offer lowered resistance to the cross bar members 330, their wings 740, 750 will catch and hold on the ribs and the cycle will proceed as shown in FIG. 9 until the tank is fully emptied. The dimensions of the wings 740, 750 and other components of the cross bar members can be sized and arranged so that break-away ceases when the toner supply is nearing a predetermined level that necessitates the scooping action of the cross bars.

The foregoing has been a detailed description an illustrative embodiment of this invention. Various modifications and additions can be made without departing from the spirit and scope thereof. For example, the size, shape and arrangement of the toner tank, metering components, gearing and other mechanisms can be varied. The agitator described herein can also be employed with a standard-capacity (OEM) or high-capacity cartridge without the depicted volume extension member. The size and shape of the break-away wings can be varied and more or fewer sets of wings can be provided to one or more of the cross bar members. The material from which the cross bar members are formed is also highly variable. The break-away components can be unitary with the rest of the member or can be separate members that interengage the ribs and/or cross bar members. It is further contemplated, in an alternate embodiment, that ribs may not be rotationally aligned, but may be staggered in pairs around the circumference of the shaft with break away cross bar members located therebetween. Accordingly, this description is meant to be taken only by way of example, and not to otherwise limit the scope of the invention.

What is claimed is:

1. An agitator for a toner cartridge comprising:

an agitator shaft that extends along a rotational axis and a plurality of radially directed ribs;

a plurality of cross bar members that rotate freely about the agitator shaft are engaged by the ribs against free rotation when the shaft moves in a direction of shaft rotation, the cross bar members being constructed and arranged to break away from engagement by the ribs and into free rotation on the shaft in response to application of predetermined resistance thereto against the direction of shaft rotation such that the cross bar members break through the ribs when the cross bar members encounter a higher level of resistance at higher toner levels, thereby allowing the cross bar members to remain seated in the toner while the ribs continue rotation through the toner; and wherein the cross bar members are constructed and arranged to remain in engagement with the ribs and rotate through the toner therewith when the cross bar members encounter a lower level of resistance at lower toner levels.

2. An agitator for a toner cartridge comprising:

an agitator shaft that extends alone a rotational axis and a plurality of radially directed ribs;

a plurality of cross bar members that rotate freely about the agitator shaft are engaged by the ribs against free rotation when the shaft moves in a direction of shaft rotation, the cross bar members being constructed and arranged to break away from engagement by the ribs and into free rotation on the shaft in response to application of a predetermined resistance thereto against the direction of shaft rotation; and wherein the cross bar members each include a cross bar having a first pair of opposing flexible wings that engage the ribs adjacent thereto.

3. The agitator as set forth in claim 2 wherein the cross bar members each include side walls having bases with holes that pass through the shaft and a tie between the bases.

4. The agitator as set forth in claim 3 wherein the cross bar members are each constructed from a flexible polymer sheet.

5. The agitator as set forth in claim 4 wherein the ribs include recesses into which each wing of the first pair of wings seat, respectively when the cross bar member is engaged by the ribs.

6. The toner cartridge as set forth in claim 3 wherein cross bar members each include a second pair of opposing flexible wings located along the side walls so as to engage the ribs.

7. A toner cartridge comprising:

a toner tank having a cylindrical inner wall;

a developer roll that receives toner from a toner supply in the toner tank;

an agitator shaft that extends along a rotational axis within the toner tank and a plurality of radially directed ribs;

a plurality of cross bar members that rotate freely about the agitator shaft are engaged by the ribs against free rotation in when the shaft moves in a direction of shaft rotation, the cross bar members being constructed and arranged to break away from engagement by the ribs and into free rotation on the shaft in response application of predetermined resistance thereto by the toner supply at a predetermined fill level against the direction of shaft rotation such that the cross bar members break through the ribs when the cross bar members encounter a higher level of resistance at higher toner levels, thereby allowing the cross bar members to remain seated in the toner while the ribs continue their rotation through the toner; and wherein, the cross bar members being constructed and arranged to remain in engagement with the ribs and rotate through the toner therewith when the cross bar members encounter a lower level of resistance at lower toner levels.

8. The toner cartridge as set forth in claim 7 wherein the cross bar members each include a cross bar having a first pair of opposing flexible wings that engage the ribs adjacent thereto.

9. The toner cartridge as set forth in claim 8 wherein the cross bar members each include side walls having bases with holes that pass through the shaft and a tie between the bases.

10. The toner cartridge as set forth in claim 9 wherein the cross bar members are each constructed from a flexible polymer sheet.

11. The toner cartridge as set forth in claim 10 wherein the ribs include recesses into which each wing of the first pair of wings seat, respectively when the cross bar member is engaged by the ribs.

12. The toner cartridge as set forth in claim 8 wherein the cross bar defines an L-shaped cross section and includes a radial outermost edge that is sized and arranged to engage the inner wall so as to scrape toner therefrom.

13. The toner cartridge as set forth in claim 8 wherein the cross bar members each include side walls having bases with holes that pass through the shaft, the holes being larger than a prevailing diameter of the shaft so that the sidewalls can slide radially a predetermined distance with respect to the ribs.

14. The toner cartridge as set forth in claim 13 wherein the cross bar defines an L-shaped cross section and includes a radial outermost edge that is sized and arranged to engage the inner wall so as to scrape toner therefrom.

15. The toner cartridge as set forth in claim 7 further comprising a compound-angle doctor blade that engages the developer roll.

16. The toner cartridge as set forth in claim 7 further comprising a volume extension member that covers an opening in the cylindrical inner wall and that extends an inner volume to house the toner supply outwardly.

17. The toner cartridge as set forth in claim 16 wherein the volume extension member is located at an upper rear of the toner cartridge with respect to a lower front outlet adjacent to the developer roll, the volume extension member having a pair of stepped bubbles on a rear face thereof.

18. The toner cartridge as set forth in claim 17 wherein the volume extension member includes an attachment flange that engages an outer surface that surrounds the opening in the cylindrical inner wall.

19. The toner cartridge as set forth in claim 7 wherein the agitator is operatively connected to the developer roll with a dual-spring floating timing wheel and gear assembly.

* * * * *